US008955681B2

(12) United States Patent
Snyder et al.

(10) Patent No.: US 8,955,681 B2
(45) Date of Patent: Feb. 17, 2015

(54) MULTI-POT DEVICE

(71) Applicants: Charles A. Snyder, Akron, OH (US); James H. Ward, Cuyahoga Falls, OH (US)

(72) Inventors: Charles A. Snyder, Akron, OH (US); James H. Ward, Cuyahoga Falls, OH (US)

(73) Assignee: Summit Plastic Company, Akron, OH (US)

( * ) Notice: Subject to any disclaimer, the term of this patent is extended or adjusted under 35 U.S.C. 154(b) by 0 days.

(21) Appl. No.: 14/259,612

(22) Filed: Apr. 23, 2014

(65) Prior Publication Data

US 2014/0311943 A1 Oct. 23, 2014

Related U.S. Application Data

(60) Provisional application No. 61/814,931, filed on Apr. 23, 2013.

(51) Int. Cl.
*B65D 85/50* (2006.01)
*A47G 7/02* (2006.01)

(52) U.S. Cl.
CPC ..... *A47G 7/02* (2013.01)
USPC ..... 206/423; 206/562; 220/737; 47/84

(58) Field of Classification Search
USPC ..... 206/562, 564, 423; 220/737; 47/87, 65, 47/84, 65.9
See application file for complete search history.

(56) References Cited

U.S. PATENT DOCUMENTS

| | | | | |
|---|---|---|---|---|
| 3,949,524 | A * | 4/1976 | Mickelson | 47/79 |
| 4,109,415 | A * | 8/1978 | Hall | 47/67 |
| 4,533,588 | A | 8/1985 | Kraft | |
| 5,481,826 | A | 1/1996 | Dickinson et al. | |
| 5,915,561 | A * | 6/1999 | Lorenzana et al. | 206/562 |
| 6,036,020 | A * | 3/2000 | Distler | 206/564 |
| 6,315,153 | B1 * | 11/2001 | Osborn | 220/737 |
| D453,309 | S | 2/2002 | Katz et al. | |
| 7,204,056 | B2 * | 4/2007 | Sieverding | 47/65.5 |
| 7,788,849 | B1 | 9/2010 | Cleveland | |
| 8,157,090 | B2 * | 4/2012 | Ingvardsen et al. | 206/315.9 |
| 2002/0092233 | A1 * | 7/2002 | Gratz | 47/84 |
| 2004/0251703 | A1 * | 12/2004 | Griffith et al. | 294/159 |
| 2006/0026898 | A1 * | 2/2006 | Klaus | 47/66.6 |
| 2008/0217206 | A1 * | 9/2008 | Shen | 206/562 |
| 2010/0193654 | A1 * | 8/2010 | Mclaughlin et al. | 248/311.2 |
| 2014/0166517 | A1 * | 6/2014 | Chapel | 206/423 |

* cited by examiner

*Primary Examiner* — Jacob K Ackun
(74) *Attorney, Agent, or Firm* — Buckingham, Doolittle & Burroughs, LLC

(57) ABSTRACT

A multi-pot device for facilitating a press fit connection between the device and a plurality of pots or planters, which enables a user to simultaneously and securely use, store, and transport multiple pots. Further, the multi-pot device does not conceal the markings located on the exterior of the individual pots. The multi-pot device comprises a top portion and a side portion. The top portion is further comprised of a plurality of spaced apart openings therein for receipt of the pots. Further, each of the openings is formed by a side that extends downwardly from the top portion, and each side is preferably comprised of a first lip, a first wall portion, a second lip, a second wall portion, a third lip, a third wall portion, a fourth lip and a fourth wall portion, the purpose of which is to form a press fit with the side walls of the pot.

10 Claims, 10 Drawing Sheets

MULTI-POT DEVICE

CROSS-REFERENCE

This application claims priority to Provisional Patent Application Ser. No. 61/814,931 filed Apr. 23, 2013.

FIELD OF THE INVENTION

This invention relates to a device comprised of a press-fit locking means for using, storing and transporting multiple pots including, without limitation, horticultural pots.

BACKGROUND

Plastic flowerpots and planters are well known in the art, and are typically formed by injection molding, blow molding, thermoforming, pressing, compression molding, or similar manufacturing techniques. Many of these manufacturing techniques offer a relatively high degree of freedom in the design of the pot and/or planter and permit the insertion of webs, reinforcing ribs, branches in walls and the like. Similarly, plastic trays, pot holders, and carriers for using, storing and/or transporting multiple flowerpots and/or planters are also well known in the art, and are typically formed by the same manufacturing techniques as flowerpots/planters. Notwithstanding, there are a number of limitations associated with prior art multi-pot devices. For example, most prior art devices are relatively flat tray like devices upon which multiple pots may be stored, displayed, transported, offered for sale, etc. However, these types of devices typically do not securely retain the individual pots/planters within the multi-pot device. Failure to properly secure the individual pots within the device may result in the pots overturning or otherwise becoming damaged, particularly while the device is being transported. Moreover, if the pots are overturned, the plant contained within the pot could also become damaged or destroyed, or their potting soil may be disturbed.

Failure to properly secure the individual pots within a multi-pot device within a retail setting also tends to encourage the purchase of individual pots/plants, as opposed to the purchase of the entire device with multiple pots/plants therein, which has a negative impact on sales and is undesirable to retail establishments. Additionally, many prior art devices are comprised of opaque or otherwise colored materials, and their design tends to block or otherwise conceal the markings and/or marketing material that is typically present on the side walls of the individual pots, thereby depriving consumers of this valuable information.

Consequently, there exists in the art a long-felt need for a single device that enables a user to simultaneously and securely use, store, and transport multiple pots/planters including, without limitation, horticultural pots/planters. Additionally, there is a long-felt need for an improved multi-pot carrier device that promotes multi-plant sales at retail locations by discouraging the removal of individual pots/planters from the device. There is also a long felt need for a relatively transparent device that does not block or otherwise conceal the markings located on the exterior of the individual pots/planters. Finally, there is a long-felt need for a device that accomplishes all of the forgoing objectives and that is relatively inexpensive to manufacture, and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The improved multi-pot device of the present invention enables a user to simultaneously and securely use, store, transport, and/or sell multiple individual horticultural pots/planters within a single device. Additionally, the improved multi-pot device of the present invention promotes multi-plant sales at retail locations by discouraging the removal of individual pots/planters from the device, and does not block or otherwise conceal the markings located on the exterior of the individual pots/planters. Finally, the improved multi-pot device of the present invention is relatively inexpensive to manufacture, and easy to use.

The multi-pot device for facilitating a press fit connection between the device and a plurality of horticultural pots or planters comprises a top portion, a side portion and a plurality of openings formed in said top portion. The top portion refers to the relative flat, elongated portion of the device and is further comprised of a plurality of spaced apart openings therein for receipt of pots. The side portion extends generally downwardly from the perimeter of top portion. Further, each of the openings is formed by a side that extends downwardly from the top portion, and each side is preferably comprised of a first lip, a first wall portion, a second lip, a second wall portion, a third lip, a third wall portion, a fourth lip and a fourth wall portion, the purpose of which is to form a "press fit" or "snap fit" with the side walls of the pot.

In a preferred embodiment, both of the first wall portion and the second wall portion of the side of the multi-pot device are typically formed at an angle of less than 90 degrees, as measured from the base of the pot, such that the inside diameter of the opening increases as you travel upward along the first wall portion and the second wall portion. By comparison, both of the third wall portion and the fourth wall portion are typically formed at an angle of greater than 90 degrees, as measured from base of the pot, such that the inside diameter of the opening decreases as you travel upward along the third wall portion and again along the fourth wall portion. Additionally, the exterior diameter of the lip portion of the pot is slightly larger than the inside diameter of the opening at the top portion so that the lip portion must be slightly compressed or deformed to get through the opening and settle into the slightly wider diameter of the fourth wall portion adjacent to the fourth lip.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
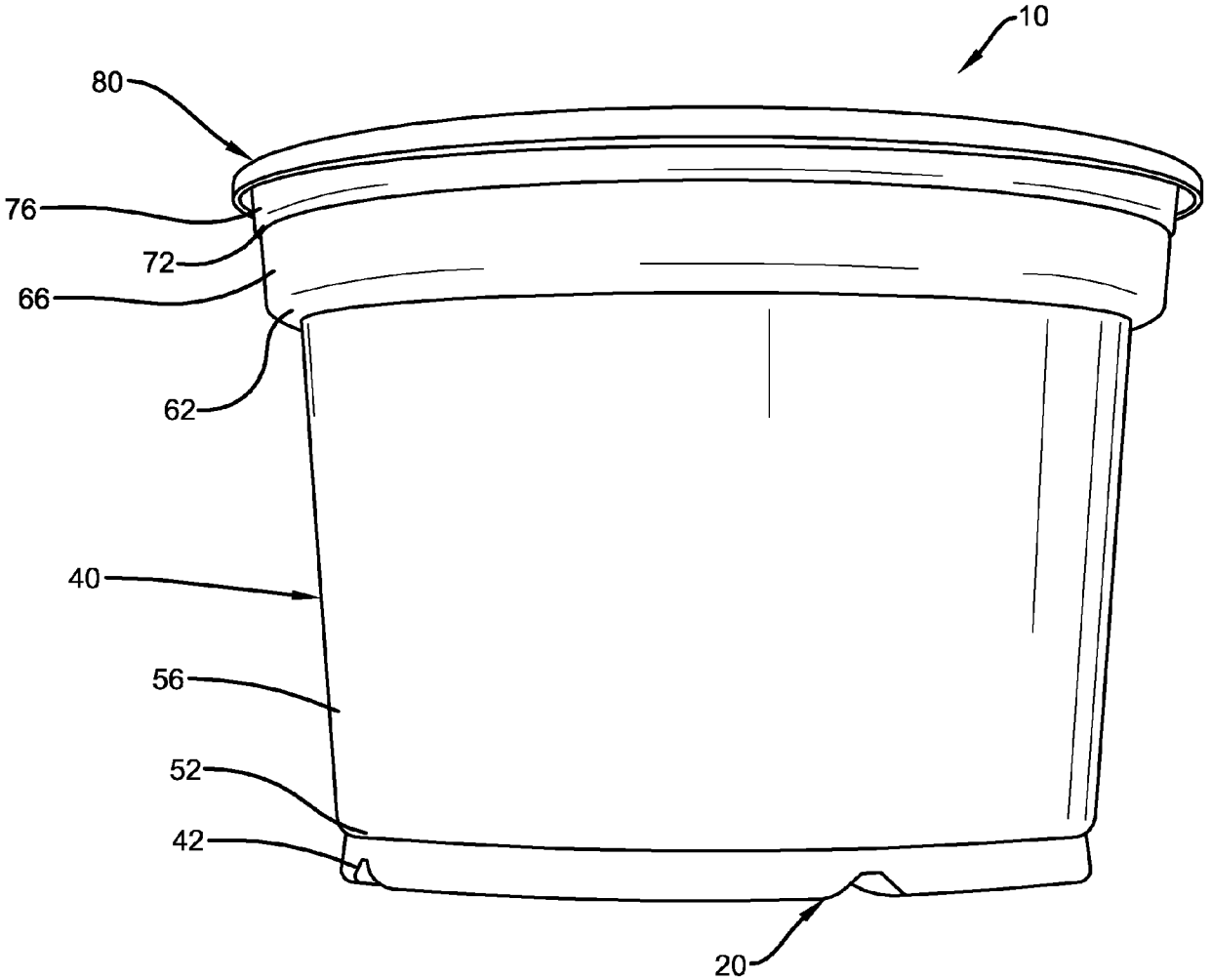
FIG. 1 illustrates a front elevational view of a prior art pot of the type that can be used with the improved multi-pot device of the present invention.
Figure 2:
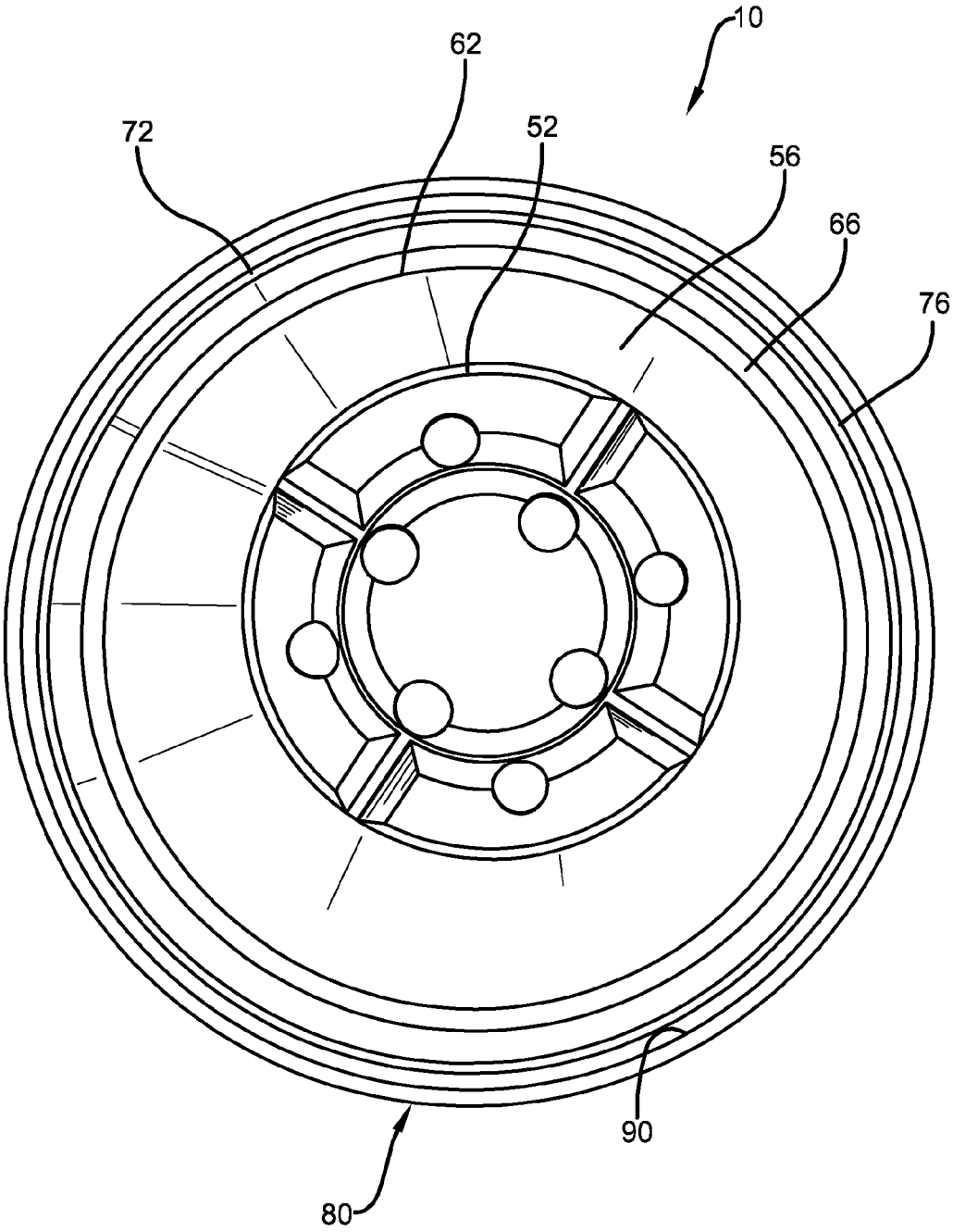
FIG. 2 illustrates a top view of the prior art pot depicted in FIG. 1.

The innovation is now described with reference to the drawings, wherein like reference numerals are used to refer to like elements throughout. In the following description, for purposes of explanation, numerous specific details are set forth in order to provide a thorough understanding thereof It may be evident, however, that the innovation can be practiced without these specific details.

The present invention discloses an improved multi-pot device comprised of a press-fit locking means for using, storing, transporting and/or selling multiple prior art individual pots/planters including, without limitation, horticultural pots/planters. The device is relatively inexpensive to manufacture, easy to use, and can be manufactured to accommodate a user selected number of pots. Additionally, the improved multi-pot device of the present invention promotes multi-plant sales at retail locations by discouraging the removal of individual pots/planters from the device, and does not block or otherwise conceal the markings located on the exterior of the individual pots/planters. Finally, the improved multi-pot device of the present invention is relatively inexpensive to manufacture, and easy to use.

The multi-pot device comprises a top portion and a side portion. The top portion is further comprised of a plurality of spaced apart openings therein for receipt of the pots. Further, each of the openings is formed by a side that extends downwardly from the top portion, and each side is preferably comprised of a first lip, a first wall portion, a second lip, a second wall portion, a third lip, a third wall portion, a fourth lip and a fourth wall portion, the purpose of which is to form a press fit with the side walls of the pot.

Referring initially to the drawings, FIG. 1 illustrates a front elevational view of an integrally formed plastic pot 10 that is well known in the art and of a type that can be used with the improved multi-pot device 100 of the present invention. While prior art horticultural pots/planters 10 are readily available in multiple sizes, shapes, colors and configurations, they are typically cylindrical in shape and comprised of a base 20, a side wall 40, a lip portion 80 and an opening 90 for inserting a plant such as a flower or the like into the pot 10.

Base 20 can be any base known in the art with respect to horticultural pots, planters and the like without affecting the overall concept of the invention. Side wall 40 is connected to base 20 and extends upward therefrom in the direction of lip portion 80. Side wall 40 is preferably comprised of a bottom portion 42, a first shelf 52, a first side wall 56, a second shelf 62, a second side wall 66, a third shelf 72 and a third side wall 76, each of which are preferably formed in side wall 40 in a generally parallel relationship to one another, and each extend around the circumference of pot 10, as best illustrated in FIG. 1.

Each of bottom portion 42, first side wall 56 and second side wall 66 are typically formed at an angle of less than 90 degrees, as measured from base 20, such that the inside diameter of pot 10 increases as you travel upward (i.e., in the direction of lip portion 80) along the bottom portion 42, first side wall 56 and second side wall 66, as best shown in FIG. 1. By comparison, third side wall 76 is typically formed at an angle of greater than 90 degrees, as measured from base 20, such that the inside diameter of pot 10 decreases as you travel upward along third sidewall 76 from third shelf 72 to lip portion 80, as best shown in FIG. 1. Lip portion 80 can be any lip portion or returning lip portion commonly known in the art and associated with horticultural pots, planters and the like.

It will be appreciated by one of ordinary skill in the art that the forgoing description of pot 10 is offered for example purposes only, and that there are a multitude of pots with different sizes and/or configurations that can be used with the device of the present invention, provided that the same is sized and configured in accordance with the principles of the present invention to correspond to the size and configuration of the pot being used.

Figure 3:
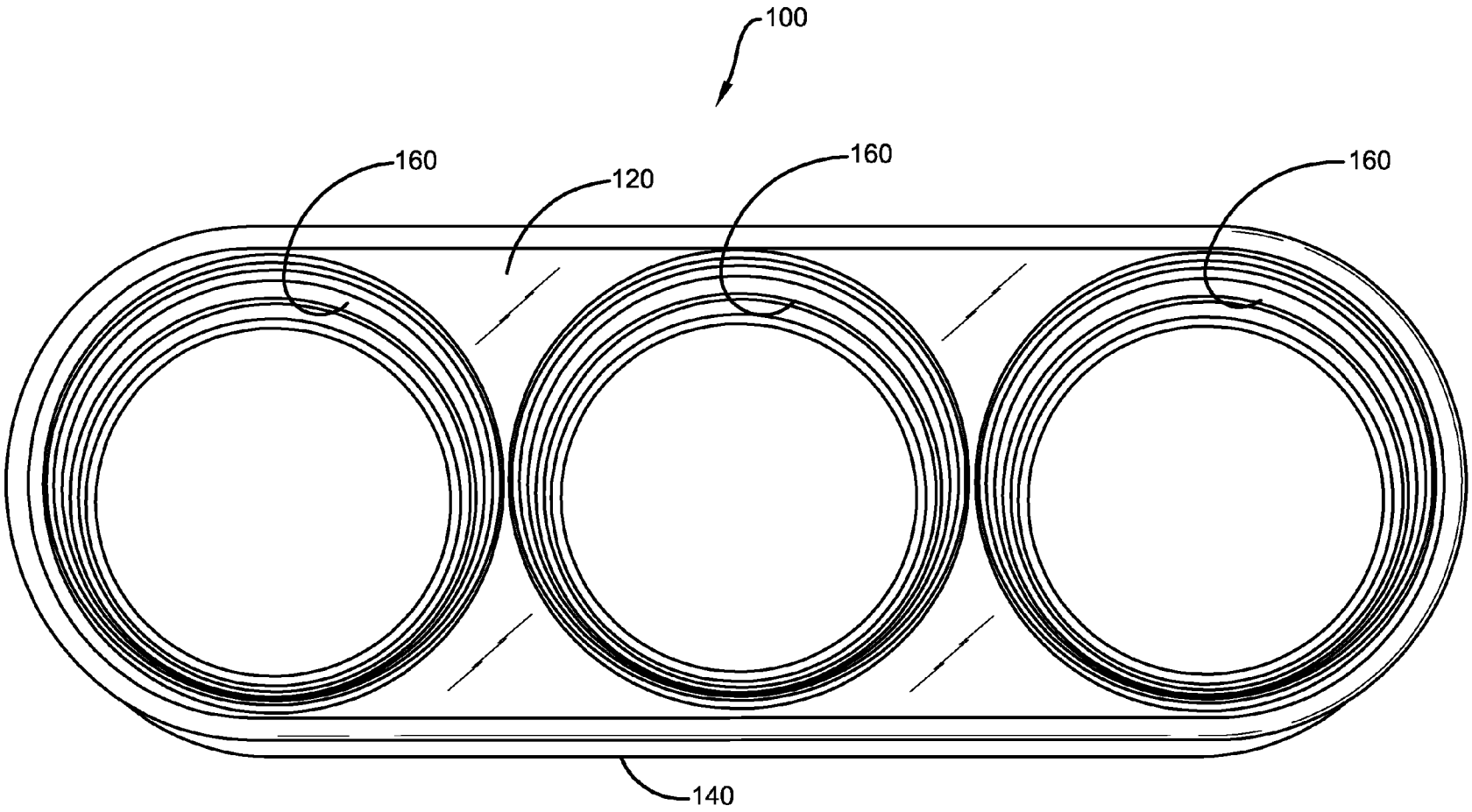
FIG. 3 illustrates a top view of one embodiment of the improved multi-pot device of the present invention.

Having described a prior art pot of the type that could be used with the present invention, the improved multi-pot device 100 will now be described. Specifically, FIG. 3 illustrates a top view of one embodiment of the improved multi-pot device 100 of the present invention, which is comprised of a top portion 120, a side portion 140 and a plurality of openings 160 formed in said top portion 120. Unless otherwise stated herein, device 100 and each of its components are integrally formed, and may be manufactured by any technique commonly known in the art for manufacturing horticultural pots including without limitation, injection molding, blow molding, thermoforming, pressing, compression molding, etc. Similarly, device 100 and each of its components may be comprised of any material commonly known in the art for use in horticultural pots including, without limitation, polyester, polypropylene, polystyrene, polyethylene or biodegradable materials such as polyactic acid, wheat based TS1, compressed rice hull or pressed bamboo fibers.

From a top view, device 100 appears to be formed in the general shape of a capsule, though it is contemplated that other shapes could also be used without affecting the overall concept of the present invention including, without limitation, a circle, ellipse, square, rectangle, triangle, etc. Device 100 is also preferably generally transparent, so as to not block or otherwise obscure any markings or marketing materials that may be affixed to, or embossed in, the pots 10. Nonetheless, it is also contemplated that device 100 can be opaque or virtually any color commonly known to be used in conjunction with horticultural products such as pots, planters, flats, carriers and the like.

Top portion 120, as best illustrated in FIG. 3, refers to the relative flat, elongated portion of device 100 and is further comprised of a plurality of spaced apart openings 160 therein for receipt of pots 10. Top portion 120 may further comprise additional handle openings 122 for receipt of an optional handle 300, as described more fully below and depicted in FIG. 6. In a preferred embodiment of the present invention, device 100 is between 15 and 27 inches in overall length and between 4 and 8 inches in overall width, though it is contemplated that other dimensions can also be used to suit user preference without affecting the overall concept of the present invention.

Figure 5:
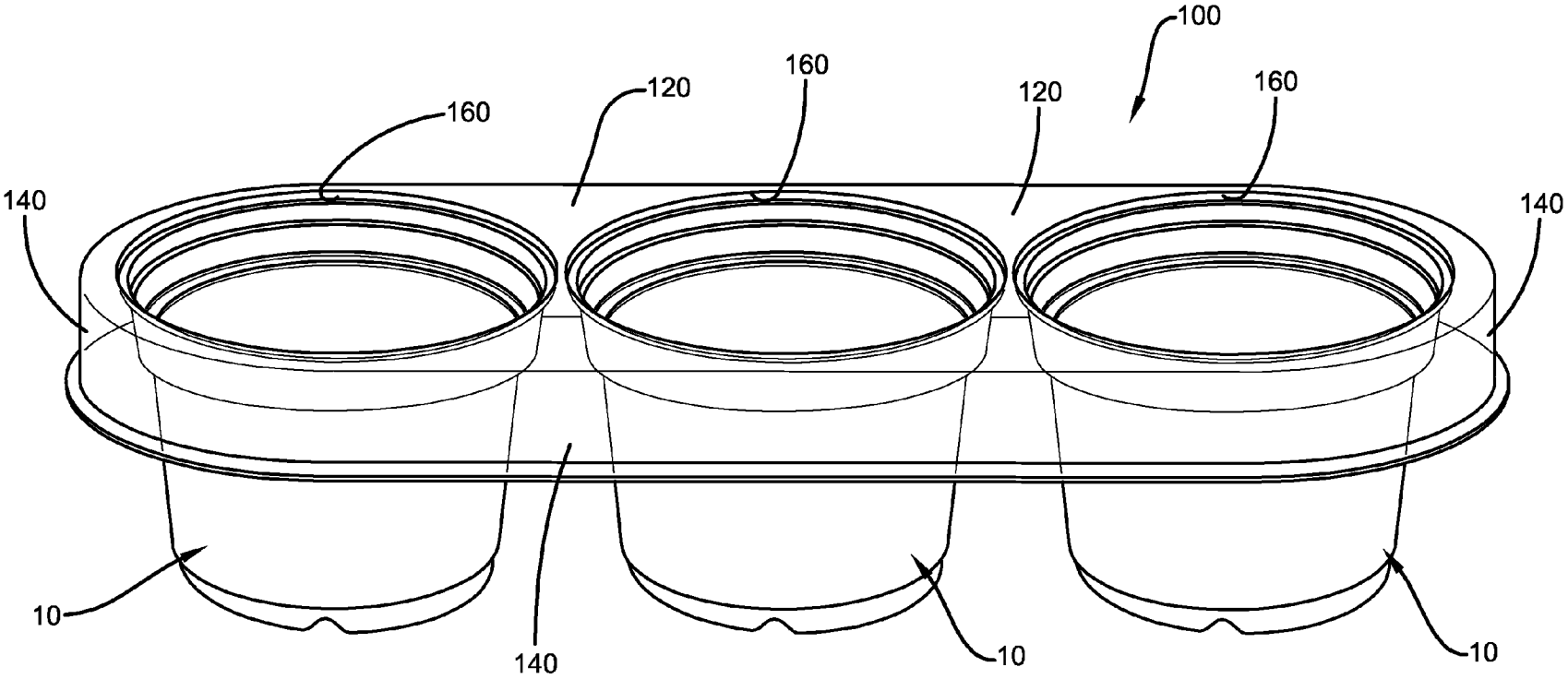
FIG. 5 illustrates a front perspective view of prior art pots installed in the multi-pot device depicted in FIG. 3.
Figure 6:
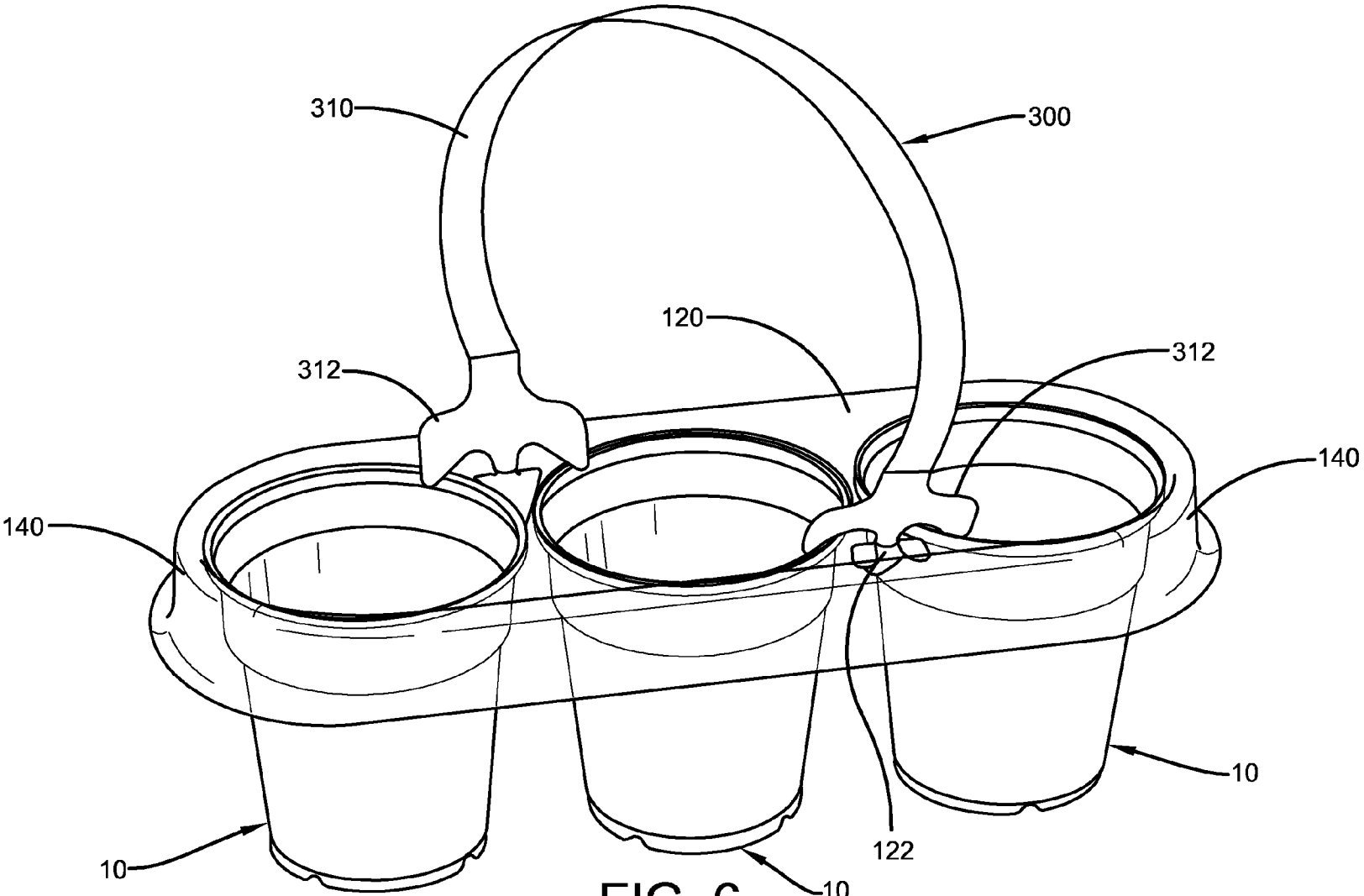
FIG. 6 illustrates a front perspective view of prior art pots installed in the multi-pot device depicted in FIG. 3 with an optional handle installed thereon.
Figure 8:
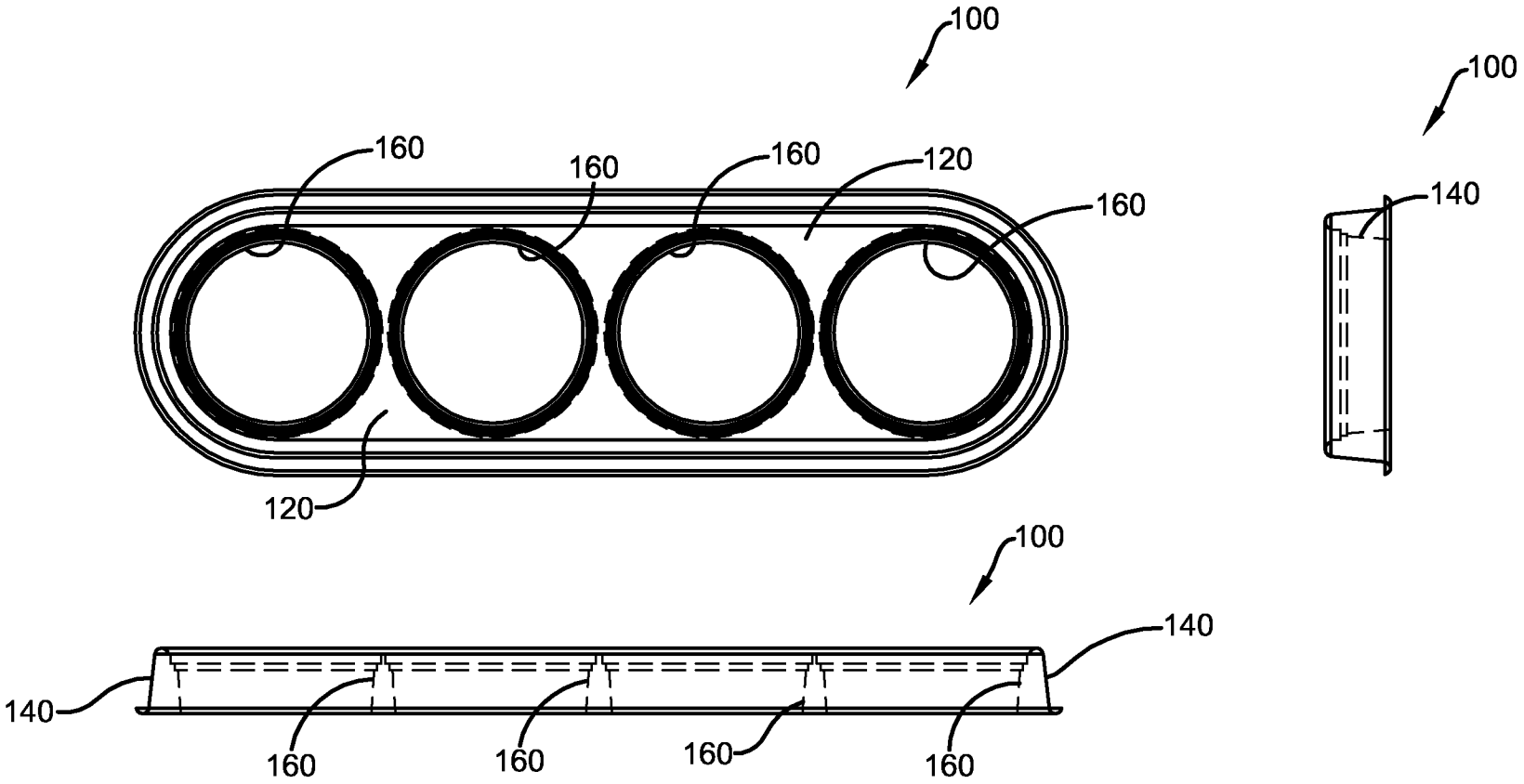
FIG. 8 illustrates front elevational, side elevational, and top views of one embodiment of the improved multi-pot device of the present invention.
Figure 9:
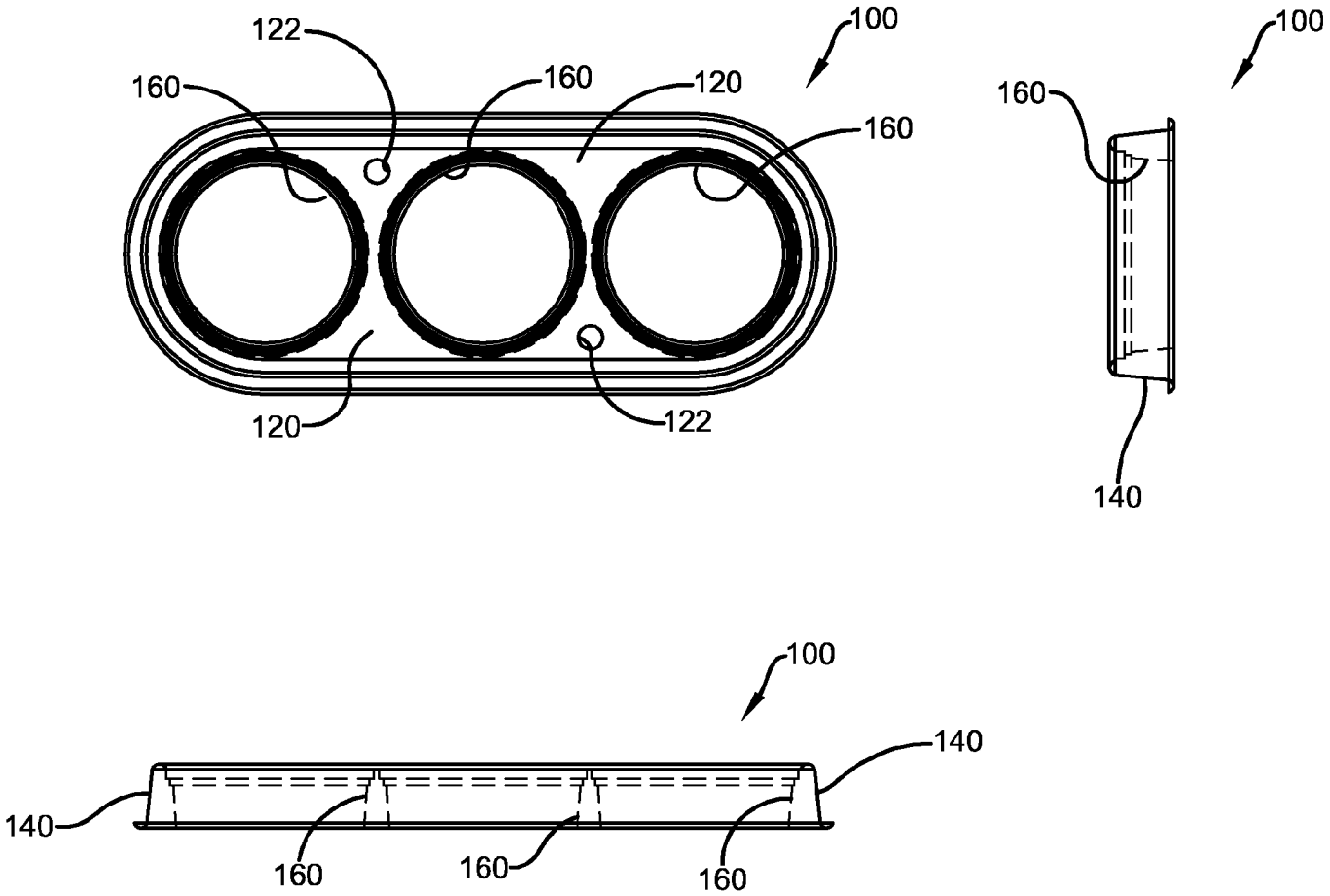
FIG. 9 illustrates front elevational, side elevational, and top views of one embodiment of the improved multi-pot device of the present invention.

Side portion 140 extends generally downwardly (i.e., in the direction of the surface upon which device 100 or pots 10 rest) from the perimeter of top portion 120, as best shown in FIGS. 5 and 6. In a preferred embodiment of the present invention, side portion 140 is between 1 and 2 inches in depth as shown in FIGS. 8 and 9, though it is contemplated that other dimensions can also be used to suit user preference without affecting the overall concept of the present invention. It will be appreciated by those of ordinary skill in the art that top portion 120 and side portion 140 may be further comprised of rounded or tapered edges, ribbing, indentations, markings and/or other structures formed therein for increasing the overall safety, strength, durability and/or aesthetics of device 100.

Figure 4:
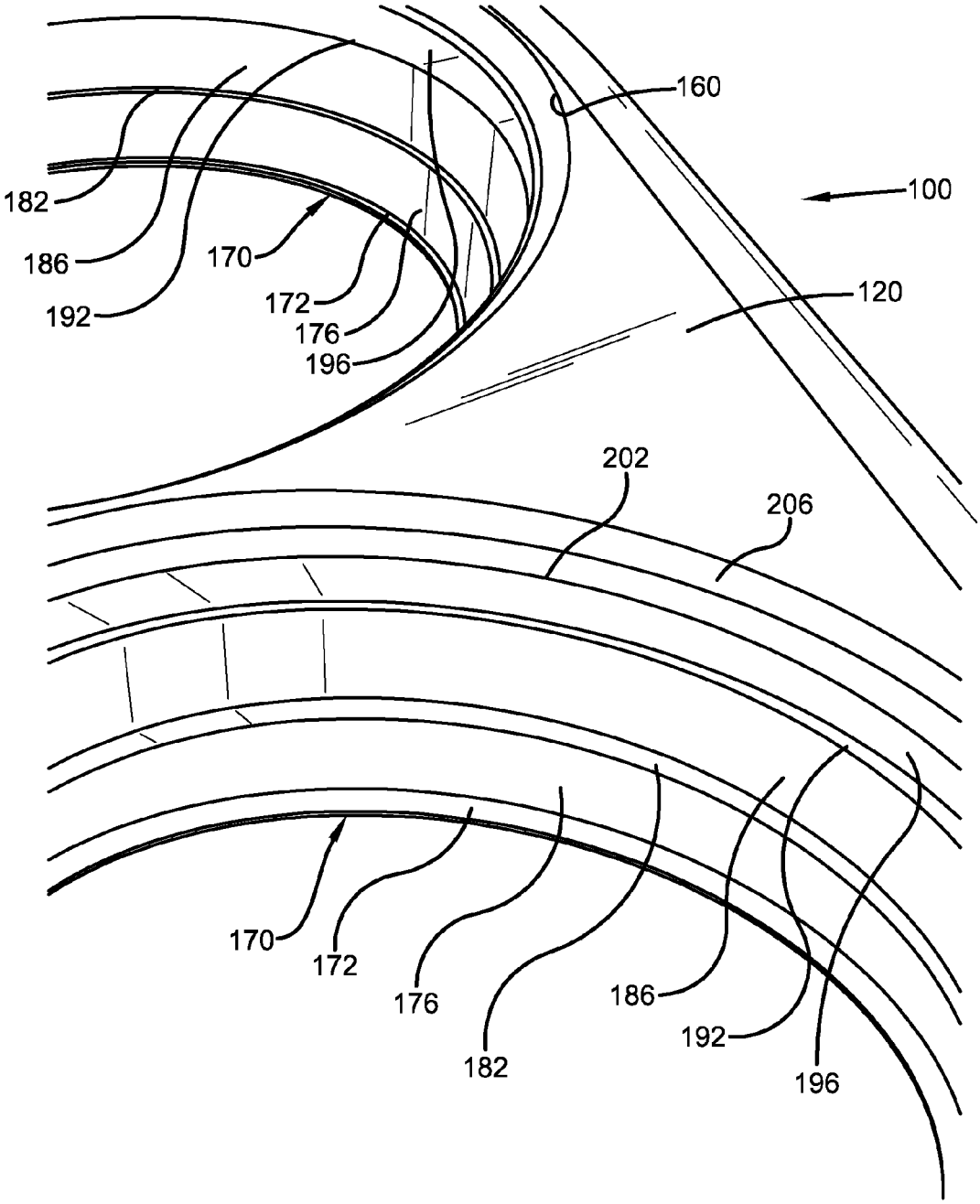
FIG. 4 illustrates a partial perspective view of the multi-pot device depicted in FIG. 3.

In a preferred embodiment of the present invention, top portion 120 is comprised of three openings 160, though it is also contemplated that device 100 may be comprised of any number of openings 160 greater than two without affecting the overall concept of the present invention. For example, FIG. 8 depicts a top portion 120 with four openings 160. Each of openings 160 is bounded or formed by a side 170 that extends downwardly from top portion 120, as best depicted in FIGS. 3 and 4. Each of sides 170 is preferably further comprised of a first lip 172, a first wall portion 176, a second lip 182, a second wall portion 186, a third lip 192, a third wall portion 196, a fourth lip 202 and a fourth wall portion 206, the purpose of which is to form a "press fit" or "snap fit" with a number of the components of pot 10, as described more fully below.

Each of first wall portion 176 and second wall portion 186 is typically formed at an angle of less than 90 degrees, as measured from base 20, such that the inside diameter of opening 160 increases as you travel upward (i.e., in the direction of top portion 120) along the first wall portion 176 and second wall portion 186, as best shown in FIG. 4. By comparison, each of third wall portion 196 and fourth wall portion 206 is typically formed at an angle of greater than 90 degrees, as measured from base 20, such that the inside diameter of opening 160 decreases as you travel upward along third wall portion 196 and again along fourth wall portion 206, as best shown in FIG. 4.

As one aspect of the present invention, and as more fully described below, third sidewall 76 and lip portion 80 of pot 10 are designed to press-fit or snap-fit with third wall portion 196 and fourth wall portion 206 of device 100 to releasably attach/secure pot 10 to device 100. More specifically, the exterior diameter of the lip portion 80 of pot 10 is slightly larger than the inside diameter of opening 160 at top portion 120 so that lip portion 80 must be slightly compressed or deformed to get through opening 160 and settle into the slightly wider diameter of fourth wall portion 206 adjacent to fourth lip 202.

Notwithstanding the forgoing, it will be appreciated by one of ordinary skill in the art that the forgoing description of device 100 is offered for example purposes only, and that device 100 could be manufactured in a number of different sizes and configurations in accordance with the principles of the invention to accommodate pots 10 of different sizes and/or configurations, and create a press fit relationship therewith.

Additionally, in a preferred embodiment of the present invention, pot 10 is further releasably attached/secured to device 100 by the fact that the inside diameter of first lip 172 corresponds to the exterior diameter of first side wall 56 when pot 10 is properly installed in device 100, such that the two are in frictional contact around a substantial portion of the exterior circumference of first side wall 56. Similarly, it is also preferred that the inside diameter of second lip 182 corresponds to the exterior diameter of second side wall 66 such that the two are in contact around a substantial portion of the exterior circumference of second side wall 66. In addition, pot 10 may be further supported within device 100 via lip portion 80 of pot 10 resting or coming into contact with fourth lip 202 of device 100, third shelf 72 of pot 10 resting or coming into contact with third lip 192 of device 100, and second shelf 62 of pot 10 resting or coming into contact with second lip 182 of device 100.

Figure 7:
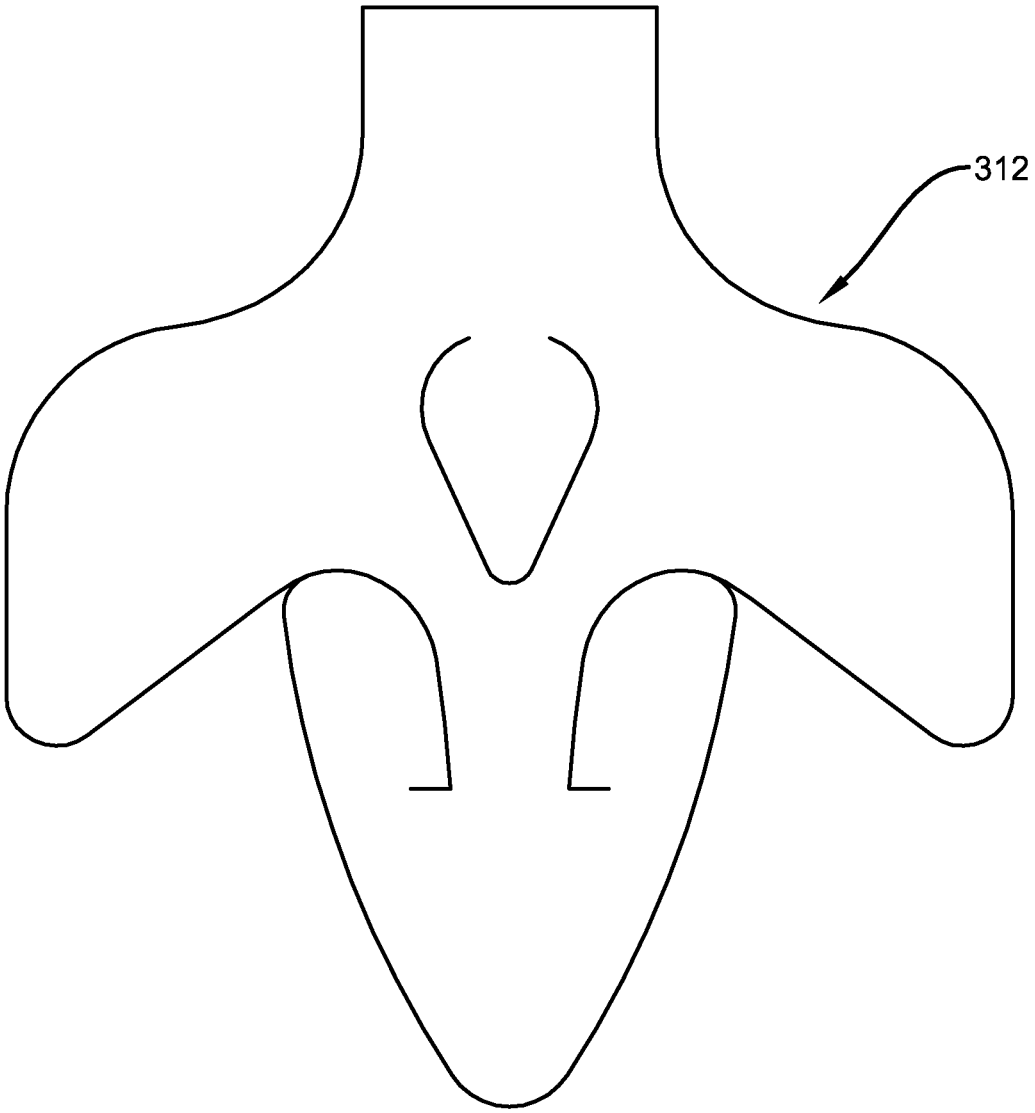
FIG. 7 illustrates a front elevational view of the latching mechanism of the optional handle depicted in FIG. 6.

FIG. 5 illustrates a front perspective view of a plurality of prior art pots 10 installed in multi-pot device 100. As depicted in FIG. 6, device 100 could further comprise a handle 300 for repositioning or otherwise transporting device 100. Handle 300 may be comprised of any suitable material known in the art for use as a handle including, without limitation, plastic, metal, organic material, or the like. In a preferred embodiment, handle 300 is decorative and comprised of an elongated flexible strap 310 with a hook or other attachment means 312 located on each end of said strap 310 for insertion into a respective handle opening 122 in top portion 120, as best illustrated in FIG. 6. FIG. 7 illustrates but one particular embodiment of hook or attachment means 312, though others are also contemplated and within the scope of the present invention.

Having now described the preferred embodiment of device 100, its use and usefulness will now be described. A user (not shown) desiring to use, store, sell, offer for sale or transport one or more prior art pots 10 may insert each of prior art pots 10 down into opening 160 from above top portion 120. As pot 10 is lowered into opening 160, the user will apply gentle pressure to the pot 10 in the direction of opening 160, as if attempting to push pot 10 further through opening 160, thereby causing lip portion 80 of pot 10, whose outside diameter is slightly larger than the inside diameter of opening 160 at top portion 120, to slightly compress or deform and pass through opening 160 and settle into the slightly wider diameter of fourth wall portion 206 adjacent to fourth lip 202 in a press-fit relationship. This press fit relationship removably secures pot 10 to device 100. Notwithstanding, a user who desires to remove an individual pot 10 from device 100 may do so by securing device 100 in one hand and using the other hand to apply gentle pressure to pot 10 in an upward direction (i.e., in the direction of top portion 120), thereby forcing lip portion 80 of pot 10 to pass through fourth wall portion 206 and past top portion 120.

Figure 10:
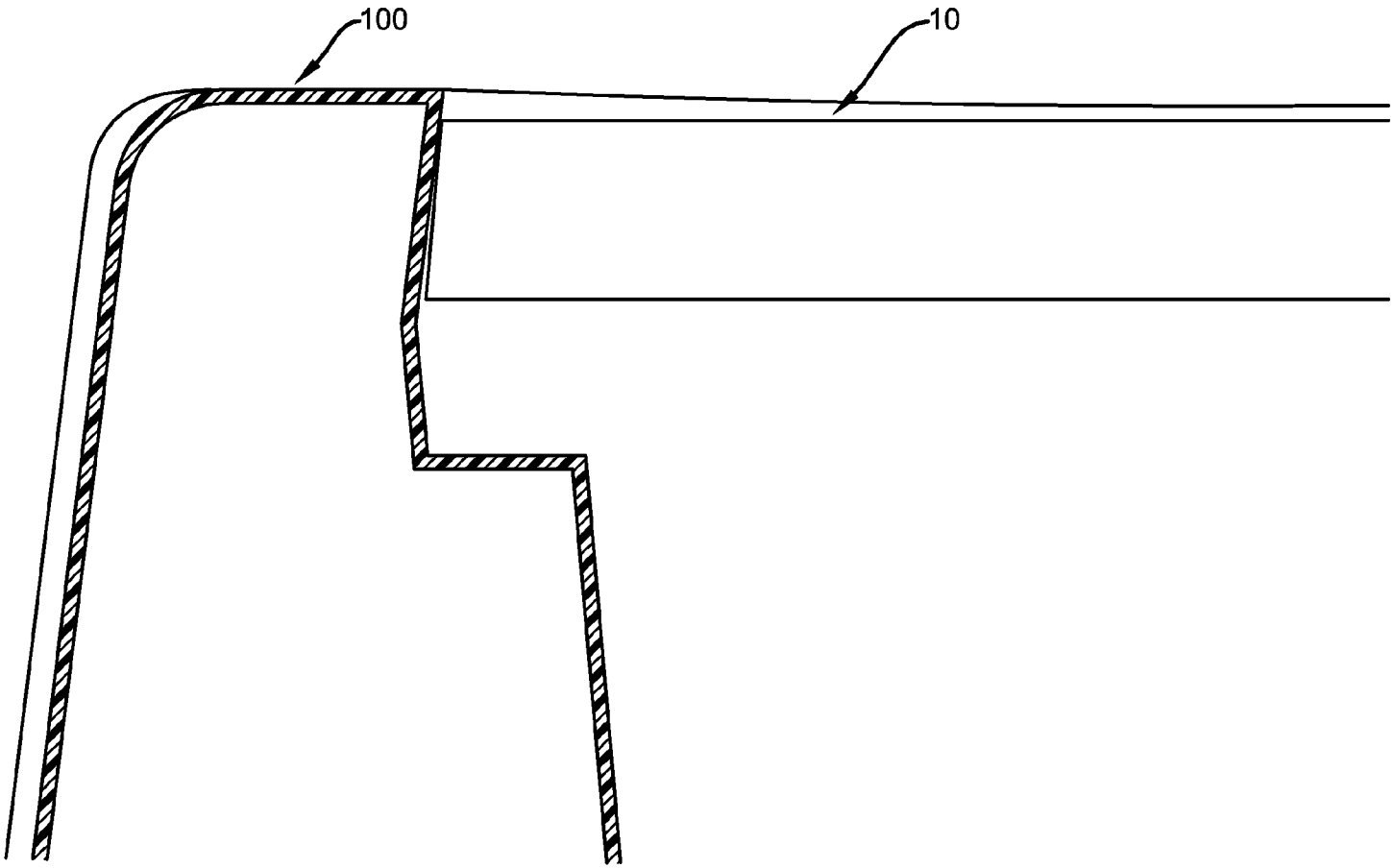
FIG. 10 illustrates a close up, elevational, cut-away view of the press fit relationship of a pot with the improved multi-pot device of the present invention.

FIG. 8 illustrates front elevational, side elevational, and top views of another possible embodiment of the improved multi-pot device of the present invention, and FIG. 9 illustrates front elevational, side elevational, and top views of yet another possible embodiment of the improved multi-pot device of the present invention. FIG. 10 illustrates a close up, elevational, cut-away view of the press fit relationship of a pot with the improved multi-pot device of the present invention.

It should be appreciated by those of ordinary skill in the art that the various dimensions of pot 10, device 100, and their respective components can vary to suit user preference and should not be construed as limitations on the present invention. It should also be appreciated by those of ordinary skill in the art that device 100 may be further comprised of ribbing, indentations, markings and/or other structures formed therein for increasing the overall strength, durability and/or aesthetics of device 100.

Additionally, other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A multi-pot device for securing at least one pot, comprising:

a top portion;

a side portion; and a plurality of openings formed in the top portion for receipt of the at least one pot; and wherein each of the plurality of openings are formed by a side that extends downwardly from the top portion; and wherein each side comprises a first lip, a first wall portion, a second lip, a second wall portion, a third lip, a third wall portion, a fourth lip, and a fourth wall portion, such that the at least one pot is secured within one of the plurality of openings via frictional contact with the first, the second, the third, and the fourth wall portions; and wherein the first and the second wall portions are formed at an angle of less than 90 degrees as measured from the at least one pot, such that an inside diameter of each of the plurality of openings increases going upward along the first and the second wall portions; and wherein the third and the fourth wall portions are formed at an angle of greater than 90 degrees as measured from the at least one pot, such that the inside diameter of each of the plurality of openings decreases going upward along the third and the fourth wall portions.

2. The multi-pot device of claim 1, wherein the top portion comprises a pair of handle openings for receipt of a handle.

3. The multi-pot device of claim 2, further comprising a handle secured to the pair of handle openings.

4. The multi-pot device of claim 3, wherein the handle is an elongated flexible strap with a hook on each end for insertion into a respective handle opening.

5. The multi-pot device of claim 1 further comprising said at least one pot, wherein the at least one pot comprises a base and a side wall connected to the base that extends upward from the base.

6. The multi-pot device of claim 5, wherein the side wall of said at least one pot comprises a bottom portion, a first shelf, a first side wall, a second shelf, a second side wall, a third shelf, and a third side wall, each of which are in a parallel relationship to one another, and each of which extend around a circumference of said at least one pot.

7. The multi-pot device of claim 6, wherein the first, the second, and the third side walls of the at least one pot correspond with the first, the second, and the third wall portions of the side of the multi-pot device.

8. A multi-pot system for securing at least one pot, comprising:

at least one pot comprising a base and a side wall connected to the base that extends upward from the base; and a multi-pot device comprising:

a top portion;

a side portion; and a plurality of openings formed in the top portion for receipt of the at least one pot; and wherein each of the plurality of openings are formed by a side that extends downwardly from the top portion; and wherein each side comprises a first lip, a first wall portion, a second lip, a second wall portion, a third lip, a third wall portion, a fourth lip, and a fourth wall portion, such that the at least one pot is secured within one of the plurality of openings via frictional contact with the first, the second, the third, and the fourth wall portions; and wherein the first and the second wall portions are formed at an angle of less than 90 degrees as measured from the at least one pot, such that an inside diameter of each of the plurality of openings increases going upward along the first and the second wall portions; and wherein the third and the fourth wall portions are formed at an angle of greater than 90 degrees as measured from the at least one pot, such that the inside diameter of each of the plurality of openings decreases going upward along the third and the fourth wall portions.

9. The multi-pot system of claim 8, wherein the side wall of the at least one pot comprises a bottom portion, a first shelf, a first side wall, a second shelf, a second side wall, a third shelf, and a third side wall, each of which are in a parallel relationship to one another, and each of which extend around a circumference of said at least one pot.

10. The multi-pot system of claim 9, wherein the first, the second, and the third side walls of the at least one pot correspond with the first, the second, and the third wall portions of the side of the multi-pot device.

* * * * *